United States Patent [19]

Elkin

[11] 4,335,875

[45] Jun. 22, 1982

[54] JOGGING ROPE HARNESS

[76] Inventor: Orville E. Elkin, 2808 S. Robinson Dr., Winnsboro, La. 71295

[21] Appl. No.: 207,064

[22] Filed: Nov. 14, 1980

[51] Int. Cl.[3] ..... A63B 23/00

[52] U.S. Cl. ..... 272/70; 272/126

[58] Field of Search ..... 272/126, 94, 70, 125, 272/143, 142, 137, 93

[56] References Cited

U.S. PATENT DOCUMENTS

| | | | |
|---|---|---|---|
| 554,636 | 2/1896 | Hulsmann | 272/142 |
| 650,656 | 5/1900 | Raabe | 272/139 |
| 1,432,013 | 10/1922 | Blake | 272/139 |
| 3,138,377 | 6/1964 | Stewart | 272/126 |
| 3,312,466 | 4/1967 | Melchiona | 272/137 |
| 3,529,820 | 9/1970 | Templeton | 272/137 |

*Primary Examiner*—Richard J. Johnson

[57] ABSTRACT

A jogging rope harness includes a length of rope directed through a cushion of soft material and having loops on opposite ends which serve as hand and arm supports. The cushion is cylindrically shaped and has a longitudinally extending aperture through which the rope is directed. The cushion may be constructed of any soft material, such as foam rubber, vinyl, or the like, and the cushion is positionable behind the neck of a runner in the manner of a collar, while the runner's hands and arms are supported by the respective loops formed on the ends of the rope.

3 Claims, 3 Drawing Figures

JOGGING ROPE HARNESS

BACKGROUND OF THE INVENTION

1. Field of the Invention

The present invention relates to exercise devices and more particularly pertains to an arm and hand support device which is designed to control the direction of movement of a jogger's arms so as to reduce upper torso twisting forces and to improve the posture of the jogger while running.

2. Description of the Prior Art

With the advent of jogging as a preferred method of exercise for many people, there has come to light a number of problems associated with jogging for which no solutions have been offered to date. One such problem has been how to train or assist a jogger to run or walk in a proper upright position. In this respect, an upright position is the best posture for affording the greatest freedom and ease of movement, and essentially requires the jogger to keep his back as straight as naturally possible. Further, the jogger's head should be substantially aligned with his back so that it is neither forward or back of the body line. Additionally, the jogger's buttocks should be effectively "tucked in" in a manner whereby a hypothetical line drawn from the top of the jogger's head through his shoulders and hips would be substantially straight, or nearly so.

By the same token, a jogger's arm movements provide a rhythm which assists him in his running, and in the proper position, the jogger's elbows should be bent slightly away from the body, neither out like wings nor pressed to the chest, and should move forward and backward in a straight, piston-like movement.

In this connection, most joggers cannot maintain proper posture and arm movement while jogging. Some joggers attempt to imitate a military brace, i.e., throwing back their shoulders and sticking out their chest; however, this produces muscle aches between the shoulder blades and some discomfort in the lower back which results in a loss of energy, as well as producing fatigue and a contraction of a whole series of back muscles. Further, this swayback posture is extremely uncomfortable, unattractive and non-conductive to good jogging habits.

Along the same line of reasoning, most joggers do not have any conception of equilibrium, which in the present case refers to the state of balance between opposing forces generated by a movement of their bodies. Specifically, if a jogger does not maintain his arms in proper position while running, a improper equilibrium will occur which may result in rapid fatigue. Some imbalance in equilibrium is to be expected when a jogger has his arms either raised or lowered in a manner whereby they develop an inward-outward, upward-downward thrust. Effectively, this movement of the arms creates a twisting or centrifugal force which distorts the posture of the body, thus tending to cause the jogger's body to "flop" about in different directions. This, of course, breaks the rhythm of the jogging, and the runner finds his arms and shoulders begin to ache because of muscular contraction. As such, the jogger is compelled to compensate for the fatique by lowering his arms to his hips and reducing his jogging speed to a slow walk. Because of this type of experience, many potential joggers become depressed and give up running after only a few attempts. Accordingly, it can be appreciated that a need exists for some means of maintaining proper arm movement, posture and equilibrium while running. This need is substantially met by the present invention.

SUMMARY OF THE INVENTION

The general purpose of the present invention, which will be subsequently described in greater detail, is to provide a jogging rope harness which, when used as intended, will substantially overcome problems associated with posture and equilibrium typically experienced by joggers. To attain this, the present invention is constructed of a collar made of a soft vinyl or rubber substance and having an opening which runs through the center thereof from end-to-end. A nylon or cotton rope may be passed through the opening of the collar, and the ends of the rope may be formed into loop-type hand supports whereby a runner may position the collar about the back of his neck and insert his hands into the respective hand supporting loops. As such, the arrangement of the present invention serves as a means of guiding a jogger's arm movements in a manner which maintains proper body posture and equilibrium which is desirable while running.

It is, therefore, an object of the present invention to provide a jogging rope harness which may be easily and economically manufactured.

It is another object of the present invention to provide a jogging rope harness which is lightweight in construction.

It is a further object of the present invention to provide a jogging rope harness which serves as a means of supporting a jogger's arms while running, thereby reducing arm fatigue.

Still another object of the present invention is to provide a jogging rope harness that serves to assist a jogger in maintaining proper body posture while running.

Yet another object of the present invention is to provide a jogging rope harness which assists a jogger in maintaining proper body equilibrium while running.

Even another object of the present invention is to provide a jogging rope harness that substantially reduces the twisting forces associated with upper body movement while running.

A still further object of the present invention is to provide a jogging rope harness that keeps a runner's hands and arms moving in a forward and reverse direction while running, rather than across the runner's body which introduces undesirable forces to his upper torso.

Yet even another object of the present invention is to provide a jogging rope harness which may be quickly and easily positioned with respect to a runner's body.

Still even another object of the present invention is to provide a jogging rope harness which may also serve as an effective weapon for warding off offensive animals or the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
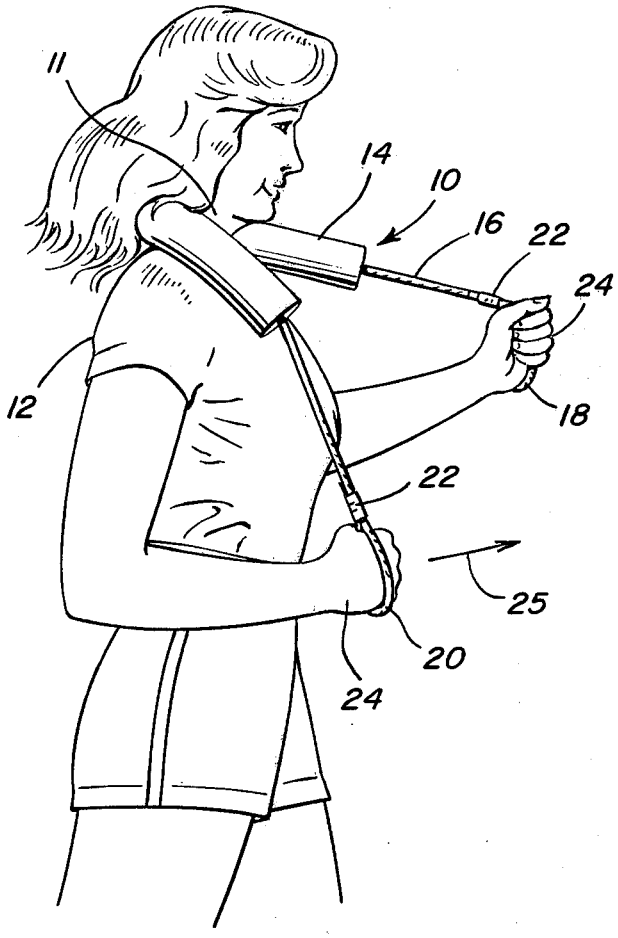
FIG. 1 is a perspective view of the jogging rope harness forming the present invention illustrating the same being utilized in its operational environment.

With reference now to the drawings and in particular to FIG. 1, a jogging rope harness employing the concepts and principles of the present invention and generally designated by the reference numeral 10 will be described in detail. In this respect, the jogging rope harness 10 is shown operably positioned behind the neck 11 and downwardly over the shoulders of a jogger 12. Specifically, the jogging rope harness 10 includes a cushion or collar 14 mounted on a rope 16 which is directed through an aperture or passageway 17 extending through the collar. Further, it can be seen that the jogger's hands may be respectively positioned in a pair of loop hand supports 18, 20 formed on the opposed ends of the rope 16.

Figure 2:
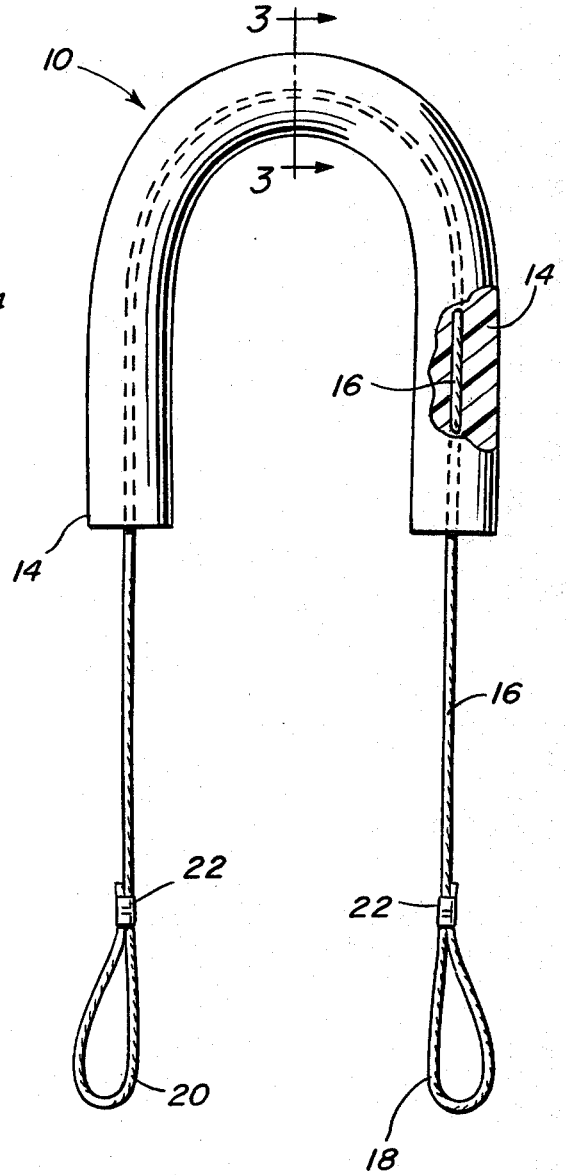
FIG. 2 is a top plan view, partly in section, of the jogging rope harness illustrated in FIG. 1.
Figure 3:
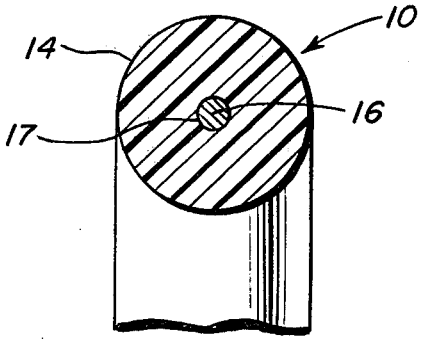
FIG. 3 is a transverse cross-sectional view of the present invention taken along the line 3—3 of FIG. 2.

With reference to FIG. 2, a better understanding of the construction of the jogging rope harness 10 can be ascertained. In this regard, it can be seen that the rope 16 is of a continuous integral construction whereby the same is directed substantially entirely through a length of the cushion or collar 14. In this connection, reference is made to FIG. 3 in conjunction with FIG. 2 where it can be seen that the rope 16 is centrally positioned within the collar 14 so that a constant thickness of the collar is circumferentially presented about the outside surface of the rope. Further, it can be seen that the rope 16 is folded back on itself to form the loops 18, 20, and may then be secured thereto by any conventional means 22, such as metal crimps, taps, etc.

In the preferred embodiment, the jogging rope harness 10 will have its cushion or collar 14 constructed of a soft material, such as vinyl, vinyl covered foam plastic, foam rubber, or some other rubber-like substance, and the collar might, if desired, be approximately 22" long and 2" in diameter. The opening formed in the cushion or collar 14 might be approximately $\frac{3}{8}$" in diameter and will be centrally positioned therein so that a nylon or cotton rope which is approximately $\frac{1}{4}$" in diameter and 42" in length may be passed therethrough. Of course, it is to be understood that the length of the rope, as well as the material from which it is constructed, may be varied. For example, it is obvious that rope lengths will by necessity be different depending upon the size of the individual utilizing the jogging rope harness 10. While the loop hand grips 18, 20 are the preferred embodiment since they do not require any energy expenditure on the hands of the jogger, it is to be understood that optional hand grips might be employed, such as plastic hand grips having apertures positioned therein whereby the rope ends might be passed through the apertures and then knotted so as to prevent their becoming disengaged therefrom.

In use, a jogger 12 need only position the jogging rope harness 10 in the manner illustrated in FIG. 1, i.e., with the cushion or collar 14 positioned behind the neck and with the rope 16 extending downwardly over his or her chest whereby the respective hand grips 18, 20 may be gripped. While running then, the jogging rope harness 10 will tend to support the weight of the jogger's arms and hands 24, while at the same time directing them in a forward and backward movement as indicated by the arrow 25 and in a generally vertical plane, rather than across the jogger's body which introduces twisting and centrifugal forces on the jogger's upper torso. By transferring the weight of the arms to the upper torso through the use of the present invention, a jogger is permitted to maintain a much better posture while running, while at the same time body equilibrium is greatly improved due to the elimination of cross arm movement in front of the jogger's body. As such, muscular contraction and loss of energy is reduced, while the jogger is comfortable, confident and secure in knowing that his jogging posture and arm movements will remain constant. Further, should a hostile animal, such as a dog, or the like, attack the jogger while he is running, the harness 10 may be quickly released from engagement about the jogger's neck and then be used as a weapon to fend off the animal.

With respect to the above description, it should be realized that the optimum dimensional relationships for the parts of the invention are deemed readily apparent and obvious to one skilled in the art, and all equivalent relationships to those illustrated in the drawings and described in the specification are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A jogging rope harness for improving a jogger's body posture and equilibrium while running, walking and the like, said harness comprising a rope member of sufficient and fixed length to extend across a back of the user and having the ends terminating proximate the hands of the user, looped hand supports formed by each of the ends for receiving the hands of the user and being formed so the respective ends are secured onto an adjacent portion of the rope member forming the looped hand supports, an elongated cylindrical collar of soft cushioning material having a portion of a surface of the elongated cylindrical collar for engaging the jogger's body and having the rope member axially extending fixedly through the entire length of the elongated cylindrical collar, said elongated cylindrical collar being positionable about the jogger's upper torso and neck to facilitate supporting of said jogger's arms.

2. The invention of claim 1 wherein the rope member is nylon or cotton.

3. The invention of claim 1 wherein the rope member provides for transferring the weight of the arms while running, walking and the like to the upper torso through the use thereof and the harness is quickly released from use and engagement about the jogger's neck for use as defense means for fending off animals.

* * * * *